United States Patent [19]

Soulard

[11] Patent Number: 4,856,783

[45] Date of Patent: Aug. 15, 1989

[54] STRIKING APPLIANCE FOR A GAME OF GOLF, PLAYING AREA INCLUDING THE USE OF SAID APPLIANCE, AND A GAME ASSEMBLY COMPRISING THE APPLIANCE AND THE AREA

[76] Inventor: Charles Soulard, 174 Rue des Herses, 44240 Suce sur Erdre, France

[21] Appl. No.: 134,298

[22] Filed: Dec. 15, 1987

[30] Foreign Application Priority Data

Dec. 18, 1986 [FR] France ..... 86 17753

[51] Int. Cl.[4] ..... F63F 7/00

[52] U.S. Cl. ..... 273/87.2; 273/129 W

[58] Field of Search ..... 273/87.2, 87.4, 87 R, 273/129 W

[56] References Cited

U.S. PATENT DOCUMENTS

| | | | |
|---|---|---|---|
| 1,561,178 | 11/1925 | McGrann | 273/87.2 |
| 1,621,057 | 3/1927 | Brewer | 273/87.2 |
| 1,991,671 | 2/1935 | Hodson | 273/87.2 |
| 2,785,899 | 3/1957 | Burke | 273/87.2 |
| 3,537,576 | 6/1968 | Macaluso | 273/87.2 |
| 3,801,101 | 4/1974 | Greenberg | 273/129 W |
| 3,871,650 | 3/1975 | Casey | 273/87 R |
| 4,093,222 | 6/1978 | Eshleman | 273/87 R |
| 4,322,081 | 3/1982 | Terry | 273/87.4 |

FOREIGN PATENT DOCUMENTS

| | | |
|---|---|---|
| 187101 | of 1922 | United Kingdom . |
| 510333 | 7/1939 | United Kingdom . |
| 612044 | 11/1948 | United Kingdom . |
| 1288075 | 9/1972 | United Kingdom . |

*Primary Examiner*—William L. Freeh

*Attorney, Agent, or Firm*—Wenderoth, Lind & Ponack

[57] ABSTRACT

An appliance for simulating playing of the game of golf on a suitable playing area. The appliance includes an arm (1) at the end of which is fixed a striking member (2) in the form of a golf club of reduced size contained substantially in the same plane as the arm (1). This golf club conventionally includes a stem (3) fixed at one end to the arm (1) and carrying at its opposite end a head (4), the stem (3) and the arm (1) forming an elbow so that a ball (8) is struck by rotation of the arm (1) about its axis without intervention of mechanical transmission means.

7 Claims, 2 Drawing Sheets

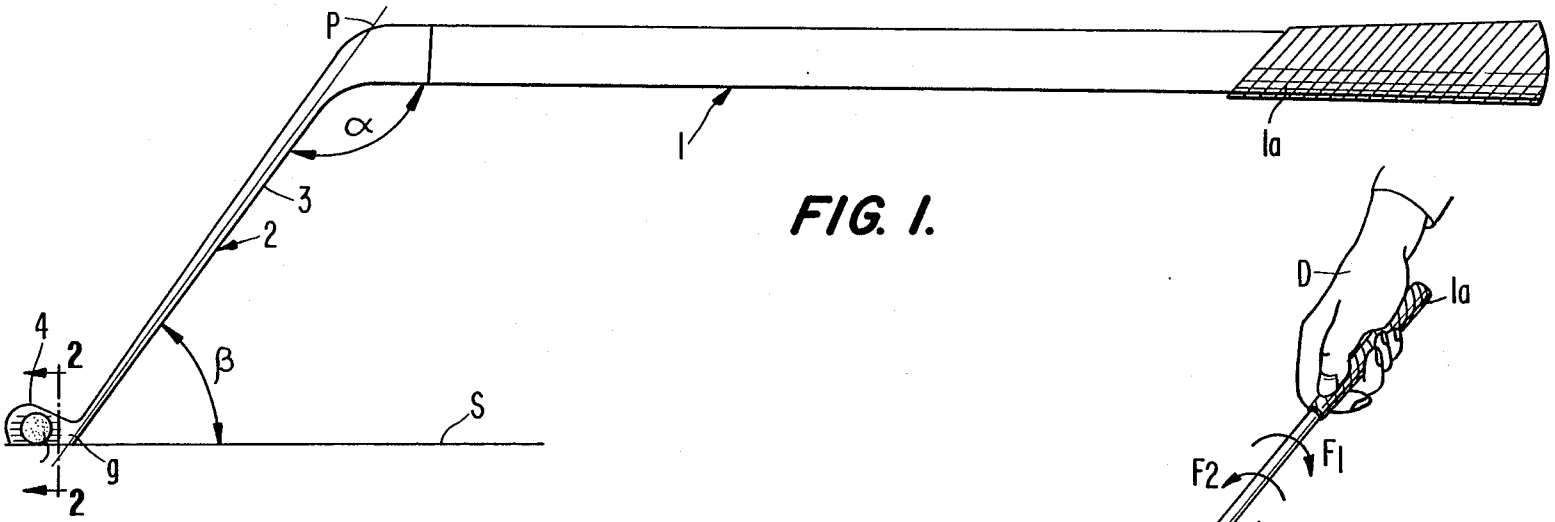
FIG. 1.
FIG. 3.
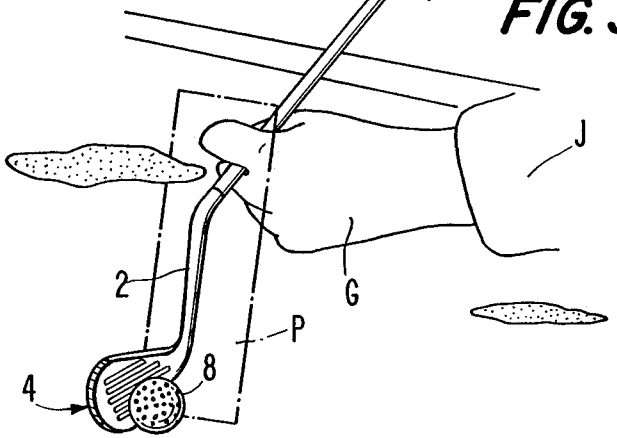
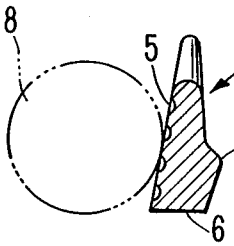
FIG. 2.

STRIKING APPLIANCE FOR A GAME OF GOLF, PLAYING AREA INCLUDING THE USE OF SAID APPLIANCE, AND A GAME ASSEMBLY COMPRISING THE APPLIANCE AND THE AREA

BACKGROUND OF THE INVENTION

The present invention relates to a striking appliance for the game of golf, this appliance being adapted to be used on a playing area disposed on a raised support such as a table or the like.

The invention also relates to areas disposed on such raised supports for use with the aforementioned appliance.

SUMMARY OF THE INVENTION

The invention therefore provides a striking appliance and a playing area which permit, in particular, the reproduction, which is as faithfull as possible on a reduced scale, of the practice of golf out in the open.

The faithful reproduction of the practice of golf is intended to mean not only the fact that there is provided an area which itself reproduces as faithfully as possible a real golf course with its obstacles, its relief, and the surface state and the flexibility of the various regions of such a course, but also the fact that the striking appliance of the invention permits, in association with the playing area, availing oneself of means for controlling the ball similar to those of the game of golf on full scale, i.e. permits aerial play by causing the ball to leave the area, and retaining the basic rules and technics of golf on full scale, in particular as concerns the relative movements of the club relative to the ball. this notion of a faithful reproduction also includes the application of ball-rotating effects when the ball must follow straight or curved trajectories.

The invention therefore provides a striking appliance for the game of golf on a playing area disposed on a raised support such as a table or the like, this appliance constituting a rigid assembly comprising a rectilinear arm at one end of which is fixed a striking member in the form of a golf club of reduced scale, the other end of the arm being provided with a handle,said striking member comprising, in the known manner, a stem fixed at one of its ends to the corresponding end of the arm by forming an elbow therewith and carrying to its opposite end a head defining a ball striking surface which is laterally oriented relative to the sleeve, said appliance being adapted to be positioned on the playing area with one hand of a user bearing on this area and supporting the arm, the other hand of the user orienting the striking surface relative to the ball by acting on the arm and causing this surface to strike the ball by a rotation of the arm around its axis, said appliance thus permitting the faithful reproduction, on a reduced scale, of the practice of golf out in the open by a sensitive control of the ball similar to that of the game on full scale, to the exclusion of any mechanical aid facilitating the striking of the ball.

According to other features:

the golf club is fixed in the extension of the arm in such manner as to extend substantially in the same plane as said arm, the inclinations of the stem relative to the arm and to the lower surface of the head of the club are such that this lower surface extends in a direction substantially parallel to the arm.

The invention also provides a playing area adapted to be disposed on at least one raised support such as a table, said area being adapted to be used with an appliance such as that defined hereinbefore and in respect of which at least some regions of its surface are yieldable.

This area reproduces, on a small scale, the real open air golf course.

It has regions having different surface conditions and regions having different yields.

The invention still further provides a playing assembly comprising at least one appliance and at least one area such as defined hereinbefore.

With this appliance, the movements of the striking member relative to the ball, namely the golf club of reduced scale, are similar to those of an open air game of golf on full scale. Consequently, with this appliance, the user may reproduce all the strokes of the usual practice of golf, for example the well known "swing". Further, the similarity of the behaviour of the striking member of the invention relative to a real golf club in combination with the properties of the surface state of the playing area, advantageously contributes to imparting to this table game, an important interest as concerns the difficulty and the sensations felt by the user which are found to be comparable to those of the real game itself.

In this description, "open air", "real" and "full scale" are employed for qualifying a club, a golf game or ground with reference to the conventional game of golf played outside on a ground or course of several hectares whose course conventionally comprises eighteen holes, which therefore has nothing to do with an outside miniature golf course or a game of golf practiced in a room on a carpet.

BRIEF DESCRIPTION OF THE DRAWINGS

A better understanding of the invention will be had from the following description of an embodiment which is given solely by way of example with reference to the accompanying drawings, in which:

FIG. 1 is a side elevational view of the appliance according to the invention, the head of this appliance being illustrated in an ideal position for striking a ball disposed on a support;

FIG. 2 is a sectional view to an enlarged scale taken on line 2—2 of FIG. 1;

FIG. 3 is a perspective view illustrating the position of the hands of a user for controlling the movements of the appliance of the invention and for positioning this appliance.

DETAILED DESCRIPTION OF THE PREFERRED EMBODIMENTS

Figure 4:
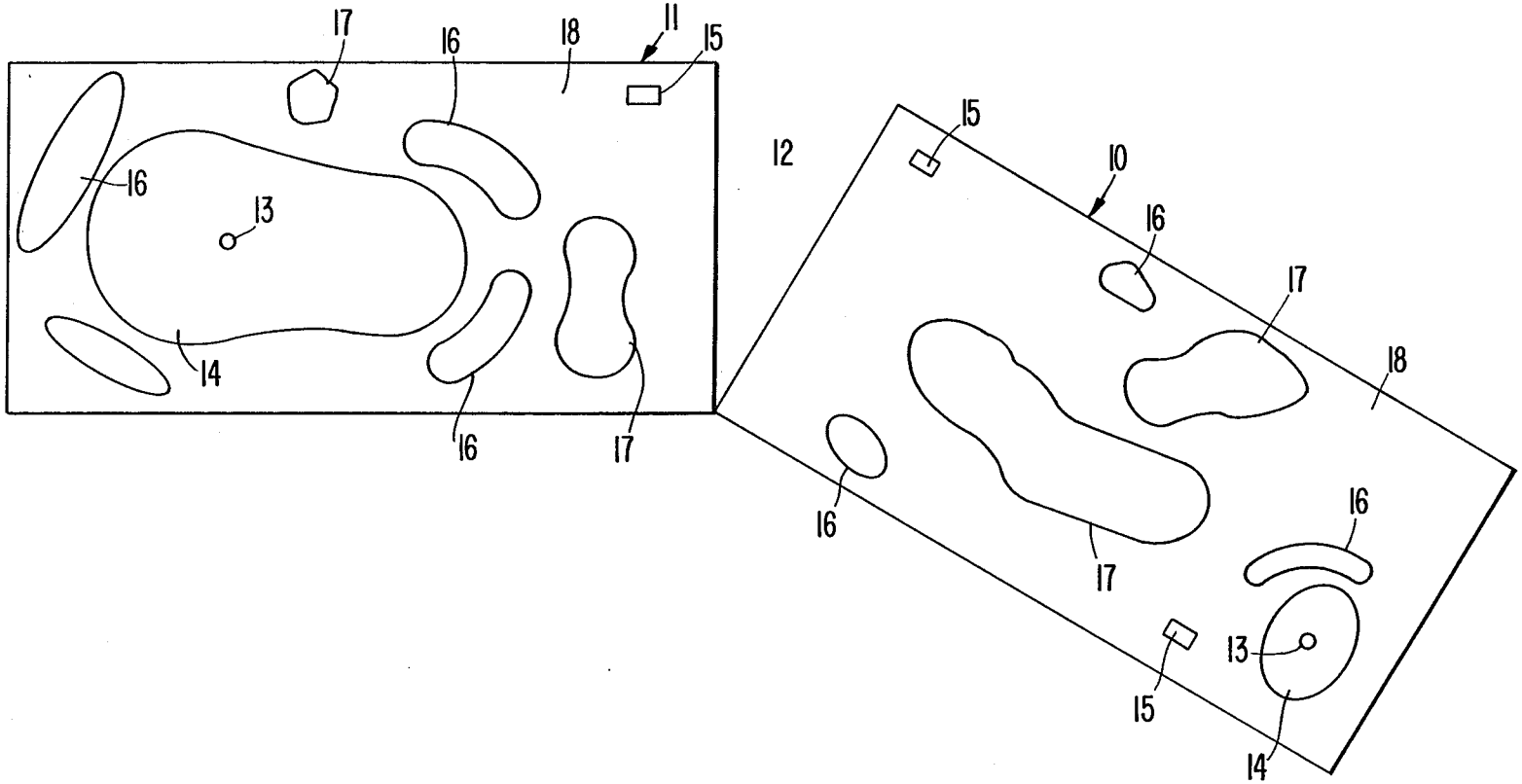
FIG. 4 is a top plan view of a playing area disposed on two neighbouring tables, this area illustrating to a reduced scale a real golf area and being adapted to be used with the appliance of the invention.

The appliance illustrated in FIG. 1 comprises an arm 1 which is substantially rectilinear at an end portion of which is provided a handle 1*a* in the form of a grip, for example of leather or rubber, the other end of the arm 1 being extended by a striking member 2 constructed in the form of a golf club of reduced scale.

The golf club 2 forming the striking member of the appliance comprises, in a manner similar to a golf club of full scale, a straight stem 3 connected by one of its ends to the corresponding end of the arm 1 and carrying, at its opposite end, a head 4 laterally defining relative to the stem 3 and to the arm 1, a striking surface 5 (FIG. 2).

The arm 1, the stem 3 and the head 4, are substantially contained in a common plane, so that the stem 3 which, in this embodiment, is in one piece with the arm 1, is located in the extension of this arm.

According to the invention, the arm 1 and the stem 3 are interconnected and form an elbow having an angle $\alpha$ of about 120° and the head 4, which is also in one piece with the stem 3 in the presently-described embodiment, is oriented relative to this stem in such manner that its lower side 6 (FIG. 2) extends preferably in a direction parallel to the arm 1 so that the angle $\beta$ made between the direction in which the stem 3 extends and the plane containing this lower side 6 is about 60°.

The value of these angles $\alpha$ and $\beta$ is given merely by way of example and the parallelism between the arm 1 and the lower side 6 is a preferred embodiment of the invention, the relative orientation of this arm and this lower side being modifiable.

Furthermore, in order to closely conform to the conditions of the full scale game of golf, the head 4 of the club 2 is provided on the surface thereof opposed to the striking surface 5 with a weight 7 adapted to impart to the appliance a certain moment of inertia relative to the arm 1 about its axis and therefore a certain power of impact of the head 4 on a ball 8 (FIG. 1). Also in order to abide by the conditions of a real game of golf, the striking surface 5 is provided with a series of grooves 9 (FIG. 1) extending in a direction roughly parallel to the lower side 6 of the head 4, these grooves being intended, in the known manner, to impart a rotating effect on the ball upon impact, this effect being known under the name of "backspin".

To complete this similarity, the striking member of the appliance of the invention and a full scale golf club, the striking surface 5 of the head 4 of the appliance may be contained in a plane which contains the arm or makes an acute angle with the plane containing the lower side 6, as illustrated in FIG. 2. In this way, there is provided a series of appliances, each used for making a particular stroke, depending on the nature of the area in which the ball is placed and on the length and the height of the trajectory that the player esteems necessary to impart to this ball.

Appliances are also provided whose arm length and stem length vary from one appliance to the other for equipping players of different sizes or heights, such as men, women, or children. The length of the arm 1 may consequently be between about 30 and 60 cms, which dimension is also a function of the extent of the playing area.

Another solution other than furnishing appliances of different sizes is to provide appliances with various adjusting means such as: means for adjusting the length of the arm 1 and means for adjusting the inclination between the stem 3 and the arm 1.

These adjusting means may comprise devices known per se, in particular the arrangement of the arm 1 or the stem, in the form of two rods slidably mounted one inside the other for adjusting the length of the stem 3 or this arm, it being possible to adjust the angle by providing between each of the corresponding elements of the appliance an articulation device with locking means.

The appliance of the invention may therefore be constructed in a single part or in a plurality of parts if there are provided articulations, or even a striking member 2 merely screwed on the arm 1 in such manner as to be capable of interchanging the striking members and adapting them on a common arm.

The appliance may be constructed in any suitable material, and in particular a metal such as aluminum or an alloy of the latter, steel or a more noble metal, a plastics material, wood, or a composite material.

With reference now to FIGS. 1 and 2, it can be seen how a player J must use the appliance of the invention for striking a ball 8 placed on a support S. The player positions the head 4 of the appliance in a suitable position for striking the ball by holding the arm 1 in proximity to the striking member 2, for example between the index and the second finger of his left hand bearing against the support S.

The left hand of the player G thus supports the appliance and so positions it that the striking surface 5 is in facing relation to the ball 8 and this striking surface is located at a suitable height relative to this ball, the height of the head 4 being adjustable relative to the ball 8 either by a contraction or crushing of the left hand J or by inserting the arm 1 between another pair of fingers of this left hand.

With the head 4 of the appliance thus positioned, the stroke can then be effected by first of all completing the positioning of this head relative to the ball 8 by a fine adjustment of the orientation of the striking surface 5, which is carried out by the right hand D of the player J which acts in the appropriate manner on the handle 2 of the appliance. In this ideal position prior to the stroke such as illustrated in FIG. 1, the lower surface 6 of the head 4 extends in a direction parallel to and in the vicinity of the surface of the support S, the striking surface 5 of the head 4 being itself in the vicinity of the ball 8.

While making an effort to keep the exact axial orientation of the arm 1, the stroke is effected first of all by turning with the aid of the right hand D the arm 1 in the direction of arrow F1 in a "backswing" movement for raising the head 4 of the club and then, from this upper position of the head 4, by turning the arm 1 in a controlled manner also by the right hand D in the direction of arrow F2 for effecting a "swing" movement in the course of which the head 4 must pass, with full impetus as it strikes the ball, through its initial position before the backswing.

As in the real game of golf, the difficulty of the stroke to be produced essentially resides in the fact that it is necessary for achieving a straight stroke to avoid modifying the axial orientation of the arm 1 and the height of the head 4 during the backswing and swing so that the stem 3 of the golf club 2 travels during these movements in the same plane P termed "swing plane".

The game with the appliance of the invention therefore exercises the address, the concentration, the precision, the reflexes and the viewing in the same way as full scale golf. The use of the appliance also produces sensations which may be likened to those felt when using a full scale golf club for making a stroke on real ground out in the open. Although the use of the appliance has been described and illustrated hereinbefore by supporting and positioning the arm 1 on the support S by means of the left hand, the right hand having then for function to rotate the arm and to perfect its orientation, the function of these two hands may of course be reversed, according to the preference of the player.

The playing area or ground illustratd in FIG. 4 reproduces to a reduced scale a real golf ground whose course includes two holes 13.

This playing area is disposed on two tables 10 and 11 which are rectangular and are in contact by one of their corners and thus define therebetween an empty space 12 representing as it were a natural obstacle or a variable difficulty, which could be a stretch of water in real golf.

There are found on this playing area the various elements of a full scale golf links out in the open, namely the two aforementioned holes 13 each disposed in a corresponding region or tees 14 termed the "green", starting regions 15 from each of which the first stroke of the course is effected, artificial obstacles in the form of "bunkers" 16 and natural obstacles in the form of reproductions of irregularities of the ground or high plants 17 corresponding to the region termed the "rough". The rest of the surface of the playing area is a region 18 termed the "fairway". Although this is not visible in FIG. 4, the playing area carried by the two tables 10 and 11 includes slopes so as to render the difficulties of the game similar to those encountered, on a golf course, out in the open.

In such a golf course out in the open, the "greens" are regions of lawn surrounding the holes in which the purpose of the game is to introduce the ball with a minimum number of strokes, these regions of lawn being maintained in perfect condition and perfectly mown, so as to bring out the slight slopes which exist in such regions and which are intentionally conserved in the interest of the difficulty of the game. The bunkers are in fact cavities provided in the fairway in which is disposed sand for constituting an obstacle. The rough comprises the regions of the playing area which usually include natural obstacles such as trees, bushes, rocky terrain or rubble. The rest of the course surface constitutes the fairway which is a stretch of mown turfed ground.

In order to reproduce on the playing area of the invention such surfaces which are different from one another in real golf played out in the open, the whole of the playing area is made from one or more more or less pliable materials having different surface conditions so as to imitate as closely as possible these fairway, rough, green or bunker regions.

Use may therefore be made of cloth, rubber, or any other synthetic material. Bunkers 16 may be for example embodied by a material similar to fur having long hairs or even by sand which enables the ball and the club to penetrate the thickness of the ground, which is also applicable for the fairway.

In a general way, the whole of the surface of the playing area should be pliable or soft, even if this surface has regions of different softness, so that this softness permits, as in the real full scale game, a striking of the ground or playing area with the head of the club for effecting certain strokes, in particular those in which it is desired to lift the ball and impart thereto a bell-shaped trajectory.

An excessivley hard surface would not allow this "aerial" game which requires a slight penetration of the head 4 of the club in the surface of the playing area to enable this head to pass below the ball and lift the latter upon impact.

For a ball having a diameter on the order of 10 mm, the diameter of the holes 13 is on the order of 12 mm. In a way similar to the real game, this ball is provided with cavities throughout its surface.

The tables 10 and 11 on which the playing area is disposed may have various dimensions and may be adjustable in height by devices provided on each of their legs, such as jacks or racks, so that it is possible not only to adjust the height of the playing area, but also to adjust the slopes of the area by acting on the inclination of each table.

what is claimed is:

1. A striking appliance for practicing a game of golf on a playing area disposed on a raised support such as a table, said appliance comprising a rigid unit including a rectilinear arm having a longitudinal axis and a first end and an opposite second end, said arm comprising means for swinging a striking member having a golf club head of reduced size for striking a ball by manually supporting said arm in one user's hand and rotating said arm about said longitudinal axis with the other user's hand, a handle comprising means for manually rotating said arm about said longitudinal axis provided at said second end of said arm, said striking member comprising a stem having a first end fixed to said first end of the arm and forming an elbow with said arm and said golf club head comprising means for striking a ball located at an end of said stem opposed to said first end of said stem, said head defining a ball-striking surface oriented laterally relative to the stem, said appliance being adapted to be positioned on said area with one hand of the user resting against said area and rotatably supporting said arm and the other hand of the user orienting said striking surface relative to the ball by acting on said arm and causing said striking surface to strike the ball by rotation of said arm about said axis, said appliance thereby permitting a faithful reproduction on a reduced scale of the practice of golf out in the open by a sensitive control of the ball similar to that of the full-scale game to the exclusion of any mechanical aid facilitating the striking of the ball.

2. An appliance according to claim 1, wherein the inclinations of the stem relative to said arm and to said lower surface of the head of the club are such that said lower surface extends in a direction parallel to said arm.

3. An appliance according to claim 1, wherein said stem makes with said arm an angle of substantially 120° and said striking head extends in a direction parallel to said arm, said lower surface making an angle of substantially 60° with said stem.

4. An appliance according to claim 1, wherein said arm comprises means for rotatably supporting said arm by one hand of a user of said appliance such that one hand is rested on a support surface and said arm is held by the one hand the support surface at a point on said arm adjacent to said elbow.

5. An appliance acording to claim 1, wherein said club is in one piece with said arm.

6. An appliance according to claim 1, wherein said arm and said lower surface of said striking head are in parallel planes and said head includes in a rear part of said head a weight adapted to impart to the appliance a moment of inertia, said striking surface of said head being provided with a series of grooves which extend in a direction parallel to said lower surface of said head and parallel to said axis of the arm.

7. A game assembly for playing a game of golf comprising in combination:

a striking appliance comprising a rigid unit including a rectilinear arm having a longitudinal axis and a first end and an opposite second end, said arm comprising means for swinging a striking member having a golf club head of reduced size for striking a ball by manually supporting said arm in one user's hand and rotating said arm about said longitudinal axis with the other user's hand, a handle comprising means for manually rotating said arm about said longitudinal axis provided at said second end of said arm, said striking member comprising a stem having a first end fixed to said first end of the arm and forming an elbow with said arm and said golf club head comprising means for striking a ball located at an end of said stem opposed to said first end of said stem, said head defining a ball-striking surface oriented laterally relative to the stem;

means defining a playing area and at least one raised support carrying said playing area, said playing area having a surface on which at least some regions are yieldable;

said appliance being adapted to be positioned on said area with one hand of the user resting against said area and rotatably supporting said and the other hand of the user orienting said striking surface relative to the ball by acting on said arm and causing said striking surface to strike the ball by rotation of said arm about said axis, said appliance thereby permitting a faithful reproduction on a reduced scale of the practice of golf out in the open by a sensitive control of the ball similar to that of the full-scale game to the exclusion of any mechanical aid facilitating the striking of the ball.

* * * * *